United States Patent [19]

Gerry

[11] 4,327,701

[45] May 4, 1982

[54] ALTERNATING CURRENT ENERGIZED IGNITION SYSTEM

[76] Inventor: Martin E. Gerry, 13452 Winthrope St., Santa Ana, Calif. 92705

[21] Appl. No.: 165,719

[22] Filed: Jul. 3, 1980

Related U.S. Application Data

[63] Continuation-in-part of Ser. No. 112,533, Jan. 16, 1980, Pat. No. 4,293,797.

[51] Int. Cl.[3] ..... F02P 3/04

[52] U.S. Cl. ..... 123/598; 123/607; 123/620; 123/654

[58] Field of Search ..... 123/596, 598, 606, 607, 123/620, 637, 654

[56] References Cited

U.S. PATENT DOCUMENTS 3,718,125 2/1973 Posey ..... 123/598

4,293,798 10/1981 Gerry ..... 123/620 X

*Primary Examiner*—Tony M. Argenbright

[57] ABSTRACT

An inductive-capacitive cyclic charge-discharge ignition system includes an ignition transformer primary winding in parallel with a capacitor and fed by an alternating current source providing a plural number of repetition cycles during each igniter firing period. Such repetition cycles cause the capacitor and primary winding to charge and dischage during each of the repetition cycles creating a plurality of ringing periods for each igniter firing period. A diode or an additional capacitor, or both, inserted in series with the parallel combination of the first stated capacitor and primary winding, substantially increases the velocity of arc provided by an igniter. Such arc has several components composed of luminous particles extending across the entire base of the igniter. By initiating ignition timing at a very large angle in advance of top dead center piston position, very long arcs may be created at the igniter base.

9 Claims, 10 Drawing Figures

ALTERNATING CURRENT ENERGIZED IGNITION SYSTEM

CROSS REFERENCE TO RELATED APPLICATION

This application is a continuation-in-part of copending application Ser. No. 112,533, filed Jan. 16, 1980, now U.S. Pat. No. 4,293,797.

BACKGROUND OF THE INVENTION

This invention is in the field of ignition systems for fuel burning engines and in particular in such ignition sytems which have both a capacitor and an inductive winding of an ignition transformer cyclically charged and discharged in discharge aiding mode, and more particularly wherein such system produces a high velocity igniter arc.

Accordingly, neither the Kettering, capacitive discharge, nor AC system is capable of delivery of sufficient quantities of energy to fire an igniter, in order to enable the igniter to cause all fuel in an engine cylinder to be consumed and not wasted by failure of the ignition arc to burn same.

A further disadvantage of prior art ignition systems is that they cannot charge the inductor or transformer winding and the capacitor in a way so that discharge currents therefrom are additive and aid each other.

A still further disadvantage of the prior art systems is their inability to deliver sufficient energy to fire an igniter for extended periods of time.

Yet a further disadvantage of the prior art systems is their inability to deliver more than one ringing cycle during an igniter firing period.

Yet another disadvantage of the precharged inductor or capacitor prior art systems is their inability to rapidly charge the inductor due to use of DC power, with attendant inability to deliver sufficient energy to fire an igniter so as to effectively cause all the fuel to burn during an igniter firing period.

Yet another important disadvantage of any prior art system is the inability of the system to accelerate the arc luminous particles to such high velocity so that such arc can adequately overcome internal engine and fuel-flow pressures. Such prior art systems are therefore unable to use an igniter that develops long arc lengths between its electrodes. Such deficiency results in initiation of a small fuel ignited nodule during the initial ignition period which is insufficient in mass and area to cause all fuel in a cylinder to be consumed and not wasted.

Other disadvantages with such prior art systems reside in their complexity due to the need of a large quantity of electronic components which also gives rise to unreliability as well as high cost of production.

Exemplary of prior art systems is U.S. Pat. No. 3,714,507 which is a capacitive discharge system. A charge retention storage capacitor is charged by a relatively high DC voltage source, and the charge from the charge capacitor is discharged through an ignition transformer primary winding by utilizing a silicon controlled rectifier switch. Another capacitor across the primary winding is selected of such value so as to suppress electromagnetic interference due to discharge of the storage capacitor.

Another example of prior art is U.S. Pat. No. 3,312,860 which operates on a similar principle to that of U.S. Pat. No. 3,714,507, except that its high voltage DC power source is of a different design.

Still another example of the prior art is U.S. Pat. No. 3,972,315 which utilizes two ignition transformer primary windings. One of such windings is energized by the discharge of a precharged capacitor from a DC source; whereas the other of these primary windings has a a discharge current passing therethrough to combine with the capacitive discharge into the first named primary winding. This would be the principle of operation if the system were operative, but such system is precluded from operation by a hard-wire short circuit across the second named primary winding.

All of these exemplary systems miss the major point of technology of not utilizing rectangular or other AC power to feed the ignition transformer primary winding, and to feed such components as are connected in the primary winding circuit with AC power, and thus such systems cannot obtain the extremely high energy levels that would otherwise be possible when exciting the ignition transformer primary circuit components with AC power.

The technology applied by the prior art is also insufficiently advanced as to the mode of operation of an engine to obtain optimum performance and efficiency. Lack of knowledge prevails as to utilization of extremely long ignition arcs initiated at very advanced timing angles. Other relationships also unknown by the prior art is the relationship between the optimum timing arc ignition initiation angle and the engine rotational velocity.

SUMMARY OF THE INVENTION

Accordingly, one objective of this invention is to provide an ignition system which would deliver a high energy quantity during each igniter firing period so that all fuel in the engine cylinder would be ignited and converted to useful power without passing any unignited fuel into the engine's exhaust system.

A further objective of this invention is to devise an ignition system wherein the primary winding of the ignition transformer and a capacitor connected thereto would be charged in such way so that discharge currents from the primary winding and capacitor would be additive so as to increase the energy content fed to the igniter.

A still further objective of this invention is to provide an ignition system having a plurality of charge-discharge cycles of both the primary winding and capacitor connected thereto during any one igniter firing period so as to further increase the energy level fed to the igniter during such firing period.

Yet another objective of this invention is to utilize a power source to charge the primary winding and the capacitor connected thereto which will enable such primary winding and capacitor to be charged rapidly and fully.

Still another important objective of this invention is to provide an ignition system which will develop long arcs across the bases of igniters and wherein such long arcs, composed of luminous particles, shall have velocities substantially higher than velocities of arcs developed either by a Kettering, capacitive discharge or prior art AC systems.

The AC generator waveform output has the ability to charge both the capacitor and primary winding during each half of each repetition period of its output waveform. The manner in which the capacitor and primary winding are charged during each first half cycle of each of the generator's repetition periods enables discharge currents from the capacitor to add to the discharge currents of the primary winding, thereby creating a large amplitude ringing cycle having relatively steep wavefronts during each other half of the generator's repetition periods, resulting in a plurality of ringing cycles with extremely high energy content delivered to an igniter for firing such igniter during each igniter firing period.

Additionally, an igniter may be used which has a large spacing dimension between its arcing electrodes in the order of 75 to 750 thousandths of an inch (1.9 to 19 millimeters) and to create an arc of like length. Such dimension may be established by removing the usual gap-adjusting member from a conventional igniter so that arcs can travel between the axial electrode and the base periphery. Such arc would be extinguished in prior art ignition systems due to the high internal engine pressure at the conventional ignition initiation angle within the engine cylinder. However, the very high angular advance before top dead center piston position during the compression stroke in the order of 36 degrees to 120 degrees, depending on the number of engine cylinders involved, will enable such long arcs to be initiated and sustained since the cylinder pressure at such advanced angles is substantially lower than cylinder pressures at either 10 degrees in advance of top dead center piston position or at top dead center piston position, commonly used by the prior art. Such long arcs enable the establishment or a larger initial burning fuel nodule in the engine cylinder which makes possible an optimum flame front to exist by the time the piston has traveled to begin its power stroke. A relationship is established between the angular advance used and maximum or peak engine velocity for a given fuel quantity fed the cylinder during any one period of time.

DETAILED DESCRIPTION

Figure 1:
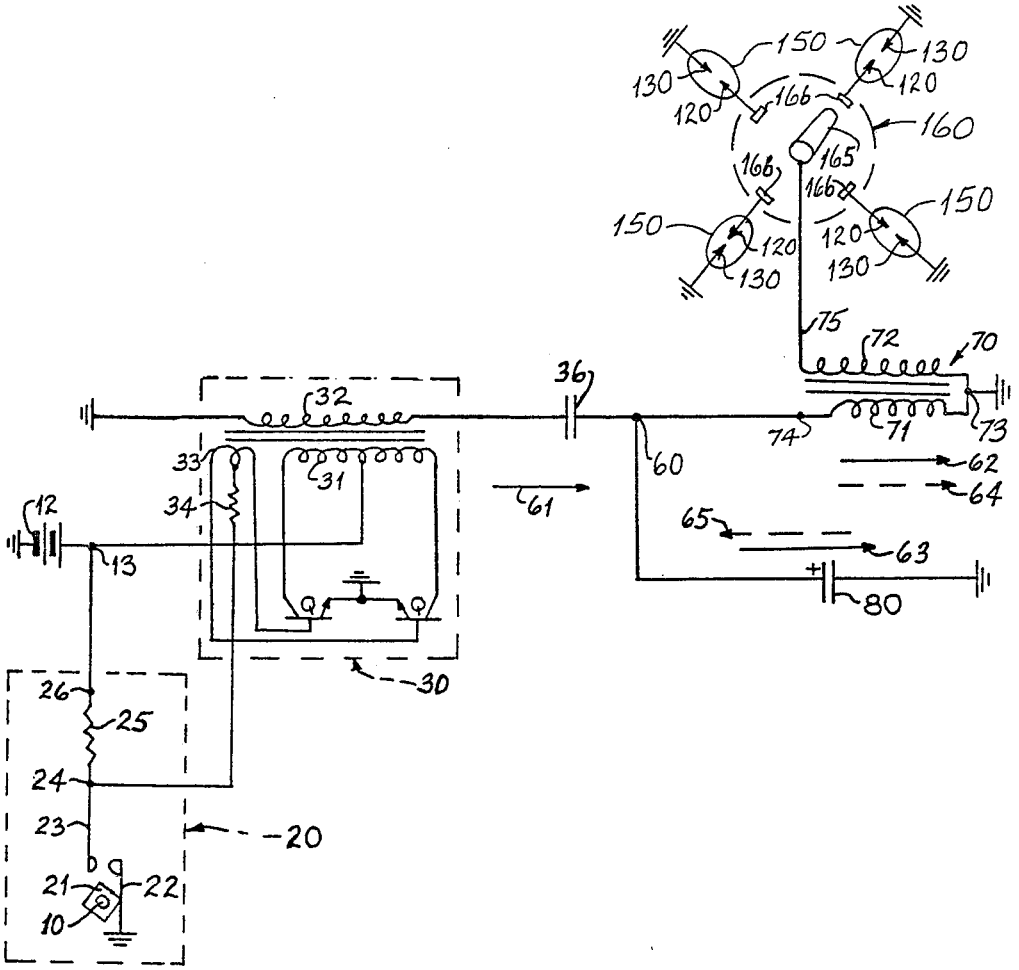
FIG. 1 is an electrical schematic of the ignition system in accordance with the invention having a switchless output network.

Referring to FIGS. 1, 1*a* through 1*g*, and 2, an ignition system delivering large quantities of electrical energy to an igniter or igniters in a fuel combustion engine, employs the principle of creating a plural number of inductive-capacitive charge-discharge cycles during any one igniter firing period. Such system is basically simple in its configuration, utilizing a minimum number of electronic components and is highly effective as well as reliable in its operation.

A conventional ground symbol in the drawings refers throughout this specification to negative battery potential which is the zero reference level for DC or AC voltages or currents, and is also a signal return path for AC signals.

Battery 12 provides DC power from its positive terminal 13 to timer 20 and to the center-tap of winding 31 of a transformer used in AC generator 30.

Timer 20 is activated by means of cam 21 driven by a conventional distributor shaft 10 so that contactors 22 and 23 are closed and opened in alternation.

Figure 2:
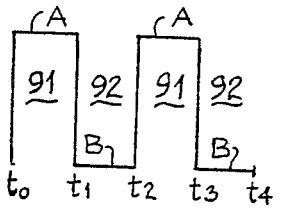
FIG. 2 is a waveform representing the output of an AC generator used in the system of FIG. 1, 1*a*, 1*b*, 1*c* or 1*d*.

When none of the high portions of cam 21 cooperates with contactor 22, contactors 22 and 23 are closed, and when one of the high portions of cam 21 cooperates with contactor 22, contactors 22 and 23 are open. Contactor 23 is connected at junction 24 to resistor 25, and resistor 25 is connected at junction 26 to positive DC terminal 13 of battery 12. Junction 24 is the point in this timer circuit used to connect to the biasing circuit of alternating current generator 30, which generator provides its waveform voltage output across winding 32, producing oscillations between its minimum levels at B and its maximum levels at A, as shown in FIG. 2.

The purpose of resistor 25 is to provide a positive DC potential to the bias circuit of generator 30 when contactors 22 and 23 are open, and also to provide a ground or zero potential to such bias circuit when contactors 22 and 23 are closed without placing a short-circuit across battery 12. The logic provided by timer 20 to circuit 30 may be briefly stated by the following table:

| Contactors 22 and 23 | DC Potential at Junction 24 | Condition of Generator 30 |
|---|---|---|
| closed | 0 | does not oscillate |
| open | + | oscillates |

Timer 20 was chosen for its simplicity so as to more easily illustrate and explain the switching functions of this system. But it should be noted that a disk-contactor timer, a magnetically generated pulse timer or an optical beam pulse timer as illustrated in FIGS. 1*e*, 1*f* and 1*g* respectively may be substituted for timer 20, if desired.

The FIG. 1 system excludes all diodes, utilizing capacitors 36 and 80. In such case, winding 32 is electrically connected to capacitor 36, and capacitor 36 is connected to junction 60. Junction 60 is the terminal at which primary winding 71 of ignition transformer 70 is connected in parallel with capacitor 80. When timer 20 causes contactors 22 and 23 to be closed, no energy will be provided by generator 30 and no power will be delivered to winding 71 and capacitor 80. But when timer 20 causes contactors 22 and 23 to open, winding 32 will excite such parallel circuit with AC energy. Since high voltage output cable 75 is normally connected to rotor 165 of a conventional high voltage distributor 160 having stationary members 166 which are connected to electrodes 120 of igniters 150 in a multiple igniter ignition system, or cable 75 is connected directly to an igniter's electrode 120 in a single igniter system utilizing igniter 150, in both instances the electrically conductive base 130 being at ground potential, the impedance looking into primary 71 will also include the reflected impedance due to secondary 72 feeding an arcing igniter.

High AC current flow is transferred from winding 31 to winding 32 of generator 30 by virtue of the inclusion of capacitor 36. Deletion of capacitor 36 will reduce the current flow through primary winding 71 and will also reduce the arc velocity.

The AC current flowing into junction 60 due to the AC voltage across winding 32 is represented by arrow 61, such current dividing into current component 62 which charges primary winding 71 and current component 63 which charges capacitor 80, so that one terminal of capacitor 80 is charged positively, as indicated. These charging current components are initiated during the conductive portions of each cycle of FIG. 2 such as represented by numeral 91 for every such half-cycle period.

It must be remembered that the AC voltage fed to winding 71 and capacitor 80 results in primary winding 71 and capacitor 80 being rapidly and completely charged. It should also be noted that the FIG. 2 waveform, by virture of its rapid charging ability, avoids the disadvantage inherent in a conventional ignition system utilizing DC power, where such DC power slowly charges the primary winding of an ignition transformer.

It should be remembered that, once charged, such winding 71 and capacitor 80 will remain charged during the flat or constant voltage portion of the conductive half-cycle period 91 of the wave of FIG. 2, at the maximum level. When something happens to disturb the circuit equilibrium, such as the forcing voltage function across winding 32 feeding these components suddenly going through a transition state such as at $t_1$, to cause the FIG. 2 voltage to drop to its minimum level, discharge currents from winding 71 and capacitor 80 will start to flow as denoted by dashed arrows 64 and 65 respectively. The discharge current flow from an inductor will continue in the same direction as its charge current direction flow, but the discharge current from a capacitor will have a direction reverse to its charge current direction, thereby aiding the discharge current in the inductor.

Consequently, between time $t_1$ and $t_2$, discharge current component 64 from winding 71 will initiate its flow direction in the same direction as its charge component 62, but discharge current component 65 from capacitor 80 will initiate its discharge flow in opposite direction to its charge component 63, as indeed it has to, since current component 65 must start flowing in a direction away from the capacitor's positively charged terminal. Hence, the discharge component 65 flowing through junction 60 will be additive to the discharge component 64 thereby increasing the current flow through primary winding 71. The same charging process will be repeated during period $t_2$–$t_3$, and the same discharge process will be repeated during period $t_3$–$t_4$ for the second cycle as well as for subsequent cycles beyond time $t_4$, during any one igniter firing period, to add the capacitor discharge current to the inductor discharge current for each cycle of FIG. 2 waveform inapposite to prior art systems which only depend upon charging either an inductor or a capacitor.

It should be realized that the discharge action causes ringing type oscillation of the parallel circuit comprising inductive winding 71 and capacitor 80, by virtue of discharge current components 63 and 65 circulating in winding 71 and capacitor 80. Hence, such ringing oscillation will occur during each quiescent wave portion 92, thereby providing a plural number of ringing cycles in sequence during any one igniter firing period. Each ringing oscillation will have both positive and negative excursions or be bipolar in character. At an average engine speed of 3,000 revolutions per minute for a four-cylinder engine having a 45 degree dwell period, an igniter would fire for approximately 5 milliseconds during which time 15 ringing cycles would be experienced. At the engine idling speed, about 45 ringing cycles per igniter firing would be experienced, and at starting speeds as much as 100 or more ringing cycles would occur, thereby facilitating starting the engine. All these ringing cycles per igniter firing may be compared with the single ringing period at substantially lower voltage and current levels provided by a conventional ignition system, in order to appreciate the advantages afforded by this functionally high energy but structurally simple ignition system.

A major benefit contributed by the system shown in FIG. 1 is its switchless output network, wherein no switch either of the electronic or other type exists. Such output network consists of primary winding 71 in parallel connection with capacitor 80, and the parallel combination in series with capacitor 36 which is also in series with output winding 32 of AC generator 30.

Alternating current generator 30 provides AC voltage excursions across winding 32 as symbolically illustrated by the waveform of FIG. 2. Such voltage excursions represent the actual voltage pattern when a resistive load is connected across winding 32. A similar rectangular waveform to that shown in FIG. 2 would represent the current excursions through winding 32 and such resistive load. When the load connected to winding 32 is reactive, as herein, and when generator 30 bias current is keyed on and off, the voltage output from generator 30 will have transient spikes. However, in explaining the theory of operation of this system, the waveform without transient spikes, as shown in FIG. 2, will be assumed.

It may be seen that generator 30 supplies a voltage output across its winding 32 which is referenced to ground, the common signal return path for both AC and DC voltages and currents, as well as the common reference point for the electrical igniters used herein. Such voltage rises from the ground reference level which is also its minimum level at B at its maximum level at A, and then stays at the maximum level for one-half cycle. At the end of such half-cycle, the voltage falls to its minimum level staying at the minimum level at B for the other half-cycle. These cyclic excursions are repeated a plural number of times for any one igniter firing period.

Although a rectangular waveshape is illustrated in FIG. 2, it is pointed out that any waveshape, regular in form or complex, may be utilized in this invention as long as the waveforms are AC in nature.

It should also be noted that winding 32 could be connected to positive DC terminal 13 of battery 12 instead of ground, in which case the waveform of FIG. 2 would be shifted upward by the voltage value of battery 12.

It may be noted that the voltage waveform across winding 32 is shown as a rectangular wave with cyclic excursions between the minimum and maximum levels. The minimum level at B may be regarded as the negative excusion of the FIG. 2 waveform and the maximum level at A may be regarded as the positive excusion of such waveform.

Such waveform almost resembles an ideal series of half-wave rectified signals. The advantage of using such waveform, even if it is changed in shape by use of an inductive-capacitive reactive load and is therefore no longer rectangular in shape, is that it is possible to cyclically charge and discharge the inductive-capacitive load components during any one cycle or repetition period of such wave without the need of any additional control components. Such advantage contributes to circuit simplicity with accompanied advantage of being able to generate a multiplicity of ringing oscillation periods during any one igniter firing period so as to very substantially increase the power and energy delivered to an igniter during its firing period.

When timer 20 keys generator 30 to its oscillatory mode by opening contacts 22 and 23 so as to provide a positive DC bias voltage to the bases of power transistors Q via feedback winding 33, base current is caused to flow through resistor 34 and through the base-emitter junction of one of the transistors Q. The circuit composed of one of transistors Q and one-half of winding 31 fed by +DC at its center tap will thereupon have collector current flowing therethrough in alternation with the other half of winding 31 and the other transistor Q via their respective collector-to-emitter junctions to ground so as to create the oscillatory waveform of FIG. 2. Though transistors Q are of the same type, each transistor has sufficiently slightly dissimilar characteristics so that one or the other transistor will draw collector current first to start the oscillation process. This type of oscillatory circuit is generally known in the art as a Royer oscillator, although generator 30 herein has been simplified over the original Royer circuit. Generator 30 has been utilized in applicant's issued U.S. Pat. No. 4,206,736. Reliability has also been added to generator 30 by component reduction and by including duty cycling of such generator by switching its bias current on and off. Such switching enables operation of the transistors about half the time during each ignition period so as to prevent their overheating and thereby improve their reliability and extend their operating life.

A single cycle of the waveform of FIG. 2 is composed of a period extending from $t_0$ to $t_2$ having a conductive portion 91 and a quiescent portion 92. Portion 91 is termed conductive since it is the half-cycle period during which time, voltage is provided by generator 30 to charge inductor 71 and capacitor 80. Portion 92 is termed quiescent since it is the half-cycle period during which time, generator 30 does not provide any output and consequently it is the cyclic portion during which inductor 71 and capacitor 80 will discharge to effect a ringing current component of decreasing amplitude and also of decreasing frequency. Keeping in mind that ringing action occurs during every cycle of rectangular wave output from generator 30, it is conceivable that any one ignition firing period may have about 60 ringing current cycles, as compared with a single ringing current cycle in a typical prior art ignition system.

Hence, when contactors 22 and 23 are initially opened for any one igniter firing period, the voltage across winding 32 rises from its minimum level at $t_0$ to its maximum level and remains substantially constant at the maximum level for the first one-half cycle, which is the conductive portion of that cycle, until time $t_1$. At $t_1$, the voltage drops to the minimum level and remains at the minimum level until time $t_2$ for the other half of the first cycle, which is the quiescent portion of that cycle. At $t_2$, the waveform starts again to rise to the maximum level to stay there until time $t_3$, at which time the voltage again drops to the minimum level and remains at the minimum level until time $t_4$, which is the end of the second cycle. Accordingly, during each conductive portion 91 of any given cycle, winding 71 and capacitor 80 are charged, and such charged components discharge during each quiescent portion 92 of the same cycle.

The rate or frequency of oscillation of generator 30 is dependent upon design of the transformer used in generator 30, but generally from 2,000 to 3,000 cycles or repetition periods per second has been found satisfactory for this ignition system. Consequently, the number of cycles or repetition periods, as exemplified by the two cycles illustrated in FIG. 2 waveform, will depend on the length of time contactors 22 and 23 stay open. When contactors 22 and 23 are closed, the zero bias provided to winding 33 of generator 30 will cut off oscillation and no output will be provided at 32. In other words, no voltage waveform as in FIG. 2 will be present across winding 32 when contactors 22 and 23 are closed.

Figure 1A:
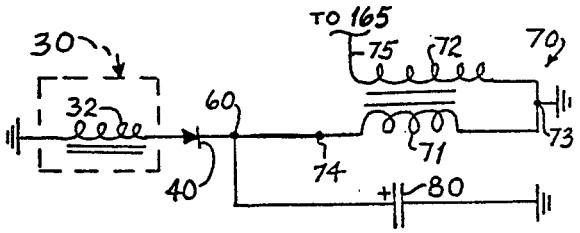
FIGS. 1*a*, 1*b*, 1*c* and 1*d* are partial schematics of switchless output networks usable in lieu of the switchless output network of FIG. 1.

FIG. 1*a* modifies the switchless output network of the system shown in FIG. 1 and as above discussed. Such modification of the output switchless network is in terms of using diode 40 in lieu of capacitor 36. As will be shown below, diode 40 also contributes a multiplicity of frequencies by its presence in the output network, causing ignition current flowing through primary winding 71 to be rich in such frequencies.

Figure 1B:
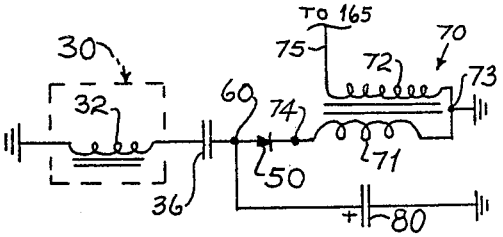

FIG. 1*b* modifies the switchless output network of the system shown in FIG. 1 and as above discussed. Such modification of the output switchless network is in terms of using diode 50 by connecting same between junctions 60 and 74. The basic performance of the output network of this figure is similar to that of FIG. 1 inasmuch as capacitor 36 is the component mostly contributing to the waveforms of current and voltage through and across winding 71.

Figure 1C:
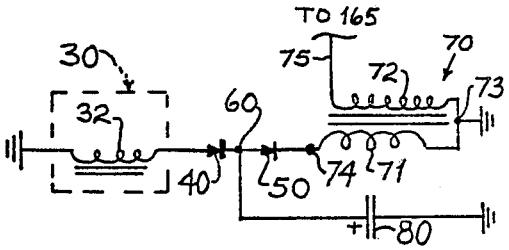

FIG. 1*c* modifies the switchless output network of the system shown in FIG. 1 and as above discussed. Such modification of the output switchless network is in terms of using diode 40 in lieu of capacitor 36, and also the inclusion of diode 50 between junctions 60 and 74. The principal function of diode 50 is to permit charging current 62 to flow through winding 71 but to inhibit winding 71 from loading down capacitor 80 and preventing premature partial discharge of such capacitor. Otherwise, the operation of the system with this output network is similar to the operation of the system utilizing the network of FIG. 1*a*.

Figure 1D:
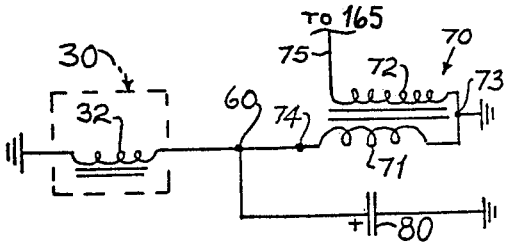
Figure 1E:
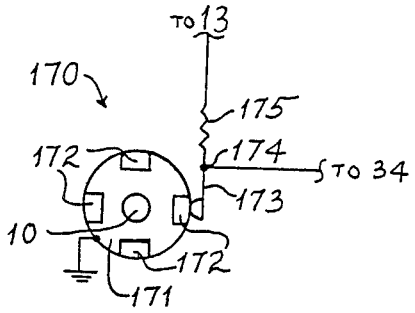
FIGS. 1*e*, 1*f* and 1*g* are respectively schematic drawings of a disk-contactor timer, a magnetically generating pulse timer and an optical beam pulse timer, any one of which can be used in lieu of the timer shown in FIG. 1.
Figure 1F:
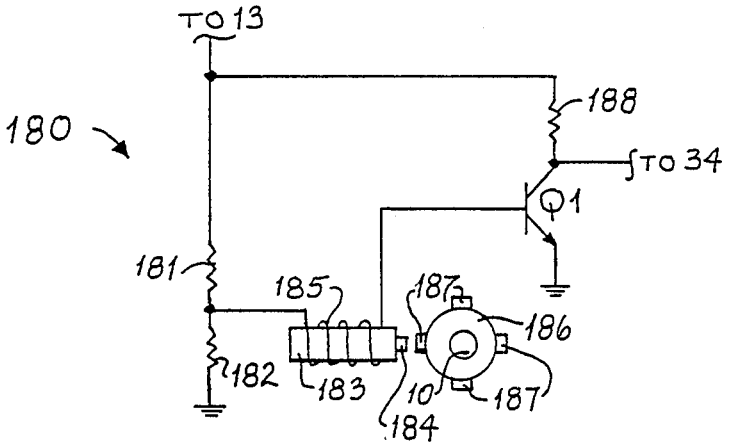
Figure 1G:
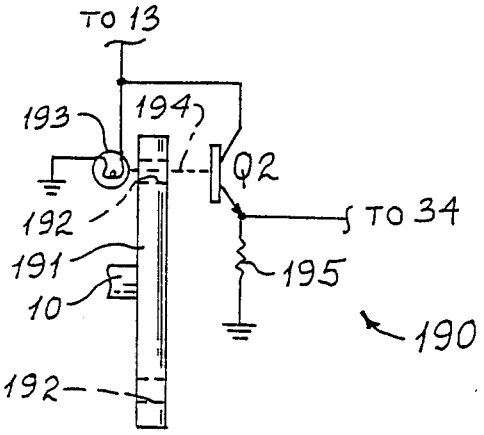

FIG. 1*d* mofifies the switchless output network of the system shown in FIG. 1 and as above discussed. Such modification of the output switchless network is in terms of deletion of capacitor 36 so that winding 32 is connected directly to the parallel combination of primary winding 71 and capacitor 80. Use of this output network reduces the ignition primary current flow and igniter arc velocity as compared with the output network as used in FIGS. 1, 1*a*, 1*b* or 1*c*.

It should be noted that diodes 40 and 50, capacitors 36 and 80, primary winding 71 and output winding 32 are all passive components since they do not internally generate electrical energy, and any electrical energy therein has to be supplied to these components. Inapposite, transistors or oscillators are active electronic components since they can contribute signal energy.

FIG. 1*e* illustrates a disk-contactor timer at 170, wherein disk 171 is of electrically conductive material and at ground potential by virtue of being affixed to engine distributor shaft 10 which is at ground potential. Disk 171 has electrically insulative members 172 regularly spaced at its periphery within the disk confines. The periphery of the disk is in cooperation with contactor 173 which has a resistor 175 in series therewith, the resistor being connected to a positive DC terminal at 13 of FIG. 1, instead of timer 20. Junction point 174 is connected to bias resistor 34 so that this timer can perform the same functions as timer 20. The logic provided by timer 170 is briefly stated in the following table:

| Contactor 173 Cooperating With | DC Potential at Junction 174 | Condition of Generator 30 |
|---|---|---|
| conductive portion of disk 171 | 0 | does not oscillate |
| member 172 | + | oscillates |

FIG. 1*f* illustrates a magnetically generated pulse timer at 180, wherein magnetic reluctor wheel 186 is driven by engine distributor shaft 10. A positive DC potential is provided to this timer from junction 13 of FIG. 1, so that this timer is connected to such junction instead of timer 20. A voltage divider resistive network 181 and 182 provides approximately +1.2 volts DC to coil 185, wound on permanent magnet core 183. Core 183 has a magnetic pole piece 184 for enabling magnetic flux to be induced in coil 185 by virtue of magnetic protrusions 187, integral with reductor wheel 186, being driven past pole piece 184 due to shaft 10 being driven by the engine. The other end of coil 185 is connected to the base of transistor Q1. Transistor Q1 has resistor 188 connected between its collector and junction 13. The emitter of Q1 is at ground potential, and the collector of Q1 is connected to bias resistor 34 of FIG. 1. When reluctor wheel 186 is at standstill, the base of transistor Q1 is at positive DC potential and Q1 conducts, thereby lowering the collector of Q1 to ground potential and inhibiting oscillation of generator 30 by virtue of zero bias being applied to the bases of transistors Q. When reluctor wheel 186 is driven by shaft 10 and when protrusions 187 are driven past pole piece 184, a negative-going spike is induced in winding 185, which spike is sufficient to overcome the positive DC potential at the base of Q1, thereby lowering the base of Q1 to a negative potential and stopping conduction of Q1 which raises the collector potential of Q1 to a positive value thereby applying a +DC bias voltage to bias resistor 34 of FIG. 1 and causing generator 30 to oscillate. The following table briefly shows the logic imposed by timer 180 upon the FIG. 1 system.

| Protrusion 187 | Potential at Base of Q1 | Condition of Q1 | DC Bias of Bases of Qs | Generator 30 |
|---|---|---|---|---|
| not driven past pole piece 184 | + | ON | 0 | does not oscillate |
| driven past pole piece 184 | − | OFF | + | oscillates |

FIG. 1*g* illustrates an optically generated pulse timer 190 which is connected to FIG. 1 in like manner as timer 20 but in lieu thereof. Timer 190 comprises an optically opaque disk 191 driven by distributor shaft 10. Disk 191 has a number of apertures 192 regularly spaced from each other at the disk periphery. A lamp or light-emitting diode 193 is connected to +DC potential at 13, and light-activated transistor switch Q2 has its collector connected to +DC potential at 13, the emitter of Q2 being connected to resistor 195 and the other side of resistor 195 being at ground potential. The emitter of Q2 is connected to bias resistor 34 of FIG. 1, so that this timer can bias generator 30 instead of timer 20. When disk 191 is driven so that is opaque portion blocks light beam 194 emanating from lamp 193, the base of Q2 is effectively at zero potential and Q2 does not conduct thereby causing its emitter to be at ground or zero potential and biasing resistor 34 to zero potential thereby inhibiting oscillation of generator 30. When disk 191 is driven to a position so that one of apertures 192 permits passage of light beam 194 therethrough to impinge on the base of Q2, the base of Q2 is raised to a positive potential which causes Q2 to conduct, thereby raising its emitter to a positive potential and biasing resistor 34 to a positive DC potential to cause generator 30 to oscillate. The logic provided by timer 190 may be briefly stated by the following table:

| Disk 191 Driven So That Light Beam 194 | Condition of Q2 | Emitter Potential of Q2 | Generator 30 |
|---|---|---|---|
| cannot impinge on base of Q2 | OFF | 0 | does not oscillate |
| impinges on base of Q2 | ON | + | oscillates |

Figure 3:
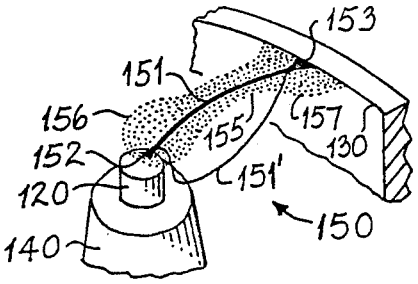
FIG. 3 is a perspective drawing of a portion of the base of an electrical igniter showing perspectively the arc phenomena created by the system of FIG. 1, 1*a*, 1*b* or 1*c*.

FIG. 3 is a representative of the arc phenomena either when diodes 40 and/or 50 are in circuit, when capacitor 36 is in circuit, or when capacitor 36 and diode 50 are in circuit.

A portion of igniter base 130 is illustrated in FIG. 3 showing its threaded part and particularly the inner periphery of such electrically conductive base 130. Axial electrode 120 which is common to igniters is embedded in ceramic insulator 140, the firing end of electrode 120 protruding from insulator 140.

The igniter is shown generally at 150 and such numeral also identifies the high velocity arc that is created by the systems used to fire the igniter. Such arc appears to comprise an elongated core or filament of concentrated luminous particles 151 having spread-out terminations 152 and 153 at both the axial electrode and inner base periphery respectively. An aura of lesser concentration of luminous particles 155 surrounds core or filament 151, the ends 152 and 153 thereof being surrounded by enlarged spherical-like aura of luminous particles 156 and 157 respectively of such lesser particle concentration. The reason for both the spread-out ends 152 and 153 and the enlarged spherical aura 156 and 157 surrounding such ends respectively appears to be due to the high impact of these luminous particles upon the electrode and inner base periphery in view of the high velocity with which these luminous particles travel between such two points of the igniter base. One can analogize this phenomena to a bullet which spreads upon impact with a solid object due to the high bullet velocity, and the high density of the object which the bullet cannot penetrate upon impact, even due to its high velocity.

In either the situation using capacitor 36 or any of the diodes in circuit, or both, when the power delivered to generator 30 was dropped by reducing the voltage from battery 12 which energizes generator 30, arc filament 151 appeared to jump out from its position surrounded by the lesser concentrated luminous particles, to a position at 151' whereupon it followed the general contour of insulator 10 to terminate at inner periphery 130 at approximately the same location as when such filament had an arc locus as at 151. During change of locus from 151 to 151' the lesser concentrated luminous particle mass remained substantially unchanged.

It should be noted that the overall high arc velocity is evidenced by audible sounds occurring upon arc impact at 120 or 130, such audible sounds being not much lower in intensity under the arc locus 151' condition as compared to the arc condition locus at 151.

In either case, one important feature of this unusual arc configuration with its high velocity is that igniters can be used that have radial spacing between arcing electrodes 120 and 130, which spacing and arc lengths could be in the order of 75 to 750 thousandths of an inch (1.9 to 19 millimeters) which arcs would not be extinguished by internal cylinder pressure during the engine compression stroke.

What is claimed is:

1. An ignition system for an engine which develops motive power by burning fuel, comprising the combination of:

an ignition transformer having a primary winding:

an alternating current generator having only one output transformer with only three windings and including active electronic power generating means, a first of said three windings being connected to said active electronic power generating means, a second of said three windings being coupled to said primary winding and forming a passive switchless network therewith, said active electronic power generating means and said first of the three windings forming an oscillatory circuit; and timing means, coupled to a third of said three windings, for controlling DC bias current to said active electronic power generating means.

2. The system as stated in claim 1, including a capacitor series connected with the primary winding and with the second of said three windings.

3. The system as stated in claim 1, including a capacitor connected in parallel with the primary winding.

4. The system as stated in claim 1, including a first capacitor series connected with the primary winding and with the second of said three windings, and a second capacitor connected in parallel with the primary winding.

5. The system as stated in claim 1, including:

a secondary winding of said ignition transformer coupled to the primary winding; and at least one electrical ignition means having an electrically conductive tubular base and an electrode insulated from said base intermittently coupled to the secondary winding for producing an electrical arc having an elongated filament composed of luminous particles and a mass of luminous particles of lesser density than said filament that surrounds said filament between said electrode and base during each ignition period.

6. The system as stated in claim 1, wherein said timing means constitutes a cam-actuated pair of contactors.

7. The system as stated in claim 1, wherein said timing means constitutes an electrically conductive disk having electrically insulative members regularly spaced at the periphery of and within the confines of said disk and an electrically conductive contactor in cooperation with said periphery.

8. The system as stated in claim 1, wherein said timing means is a magnetically generated pulse timer.

9. The system as stated in claim 1, wherein said timing means is an optically generated pulse timer.

* * * * *